US005682642A

United States Patent [19]

Michael

[11] Patent Number: 5,682,642

[45] Date of Patent: Nov. 4, 1997

[54] DETENT DEVICE AND METHOD FOR USING SAME

[75] Inventor: Daryl A. Michael, Newton, Iowa

[73] Assignee: Maytag Corporation, Newton, Iowa

[21] Appl. No.: 555,221

[22] Filed: Nov. 8, 1995

[51] Int. Cl.[6] ..... E05D 3/00

[52] U.S. Cl. ..... 16/229; 16/221; 16/379; 16/385; 16/DIG. 13; 16/257; 74/527

[58] Field of Search ..... 220/337, 338; 49/388; 16/257, 258, 229, 230, 231, 331, 227, DIG. 13, 378, 379, 221, 385; 74/527, 531; 403/327

[56] References Cited

U.S. PATENT DOCUMENTS

| | | | |
|---|---|---|---|
| 1,217,607 | 2/1917 | Karl . | |
| 1,630,524 | 5/1927 | Bruder | 16/229 |
| 2,112,399 | 3/1938 | Graham | 16/176 |
| 2,534,998 | 12/1950 | Steinbach | 16/229 |
| 2,717,717 | 9/1955 | Busch | 220/18 |
| 2,765,949 | 10/1956 | Hillman | 220/338 |
| 3,213,485 | 10/1965 | McNay et al. | 16/331 |
| 3,284,842 | 11/1966 | Jennings, Jr. | 16/386 |
| 3,375,546 | 4/1968 | Peterson | 16/258 |
| 3,408,685 | 11/1968 | Anthony | 16/169 |
| 3,488,667 | 1/1970 | Gutshall | 16/139 |
| 3,497,908 | 3/1970 | Zamarra | 220/338 |
| 3,659,314 | 5/1972 | Ross | 16/168 |
| 3,734,560 | 5/1973 | Cramblet | 16/229 |
| 3,792,887 | 2/1974 | Ramsey | 403/327 |
| 3,811,338 | 5/1974 | Federspiel | 74/527 |
| 3,921,254 | 11/1975 | Foster, Jr. et al. | 16/176 |
| 4,115,901 | 9/1978 | Schmidt | 16/176 |
| 4,570,290 | 2/1986 | Anderson | 16/258 |
| 4,782,528 | 11/1988 | Inoue et al. | 403/327 |
| 4,787,121 | 11/1988 | Racenis et al. | 16/356 |
| 4,822,965 | 4/1989 | Hyogo et al. | 220/338 |
| 4,964,526 | 10/1990 | Stephens | 220/337 |
| 5,303,291 | 4/1994 | Takagi et al. | 16/257 |
| 5,308,787 | 5/1994 | Soyka et al. | 74/527 |

FOREIGN PATENT DOCUMENTS

| | | | |
|---|---|---|---|
| 1353618 | 1/1964 | France | 16/229 |
| 300806 | 9/1917 | Germany | 16/229 |
| 1104539 | 4/1961 | Germany | 16/229 |

*Primary Examiner*—M. Rachuba
*Assistant Examiner*—Donald M. Gurley
*Attorney, Agent, or Firm*—Zarley, McKee, Thomte, Voorhees, & Sease

[57] ABSTRACT

A detent device is provided for securing a door to a frame having an opening therein. The detent device includes a sleeve having a cavity therein, an elongated plunger mounted within the cavity of the sleeve, and a spring mechanism connected to the sleeve and the plunger. The spring mechanism yieldably urges the plunger to an extended position from a retracted position. When a door is inserted into a door opening, the plunger of the detent device moves into the retracted position and then returns to the extended position in a detent receptacle.

9 Claims, 2 Drawing Sheets

DETENT DEVICE AND METHOD FOR USING SAME

BACKGROUND OF THE INVENTION

Field of the Invention

The present invention relates to a detent device and method for using same.

In the assembly of appliances, it is desirable to quickly and easily secure moving parts to a frame. Examples of such moving parts are access doors of fabric washers and dryers, stoves, and other appliances.

It is also desirable to provide a mechanism for securing such moving parts that does not damage or mar the surface of the appliance. Doors that pivot on hinges present special problems. Some doors pivot about resilient hinge balls trapped in recesses between the door and the frame. When the door is inserted during the assembly process, the hinge balls can stress and cause cracks in the surface coating of the door and the frame. Thus, there is a need in the art for a method and means of assembling doors and similar structures that neither damages nor mars the surface coating of the door or frame.

Therefore, the primary objective of the present invention is the provision of an improved detent device and method for using same.

A further object of the present invention is the provision of an improved detent device and method for using same which allows a door to be quickly and easily assembled to a frame.

A further object of the present invention is the provision of an improved detent device that does not damage or harm the structure and surface coatings of a door or a frame.

A further object of the present invention is the provision of a detent device and method for using the same which is efficient in operation, economical to manufacture, and durable in use.

SUMMARY OF THE INVENTION

The foregoing objects are achieved, in a preferred embodiment of the invention, by a detent device mounted in either a door or a frame. The detent device is comprised of an elongated plunger mounted within a cavity of a sleeve, and a spring mechanism connecting the sleeve and the plunger. The plunger is retractable within the cavity between an extended position wherein the plunger protrudes outside the sleeve and a retracted position wherein the plunger is moved toward the sleeve. The spring mechanism yieldably urges the plunger to the extended position.

To assemble the door to the frame, two detent devices are provided one in each of the opposite sides of the door or the facing sides of the frame. Detent receptacles are provided in either the door or the frame for receiving the plungers of the detent devices.

The plunger of the first detent device is inserted into the first detent receptacle. Next, the door is moved to a hinged position wherein the plunger of the second detent device extends within the second detent receptacle. Inserting the door causes the plunger of the second detent device to be forced to a retracted position and then returned to its extended position in the detent receptacle once the door reaches the hinged position.

Because the plunger of the detent device is movable between an extended position and a retracted position, the door can be easily inserted without damaging the structure or surface of the door or frame. Once the door is installed, it can pivot about the detent devices.

DESCRIPTION OF THE PREFERRED EMBODIMENTS

Figure 1:
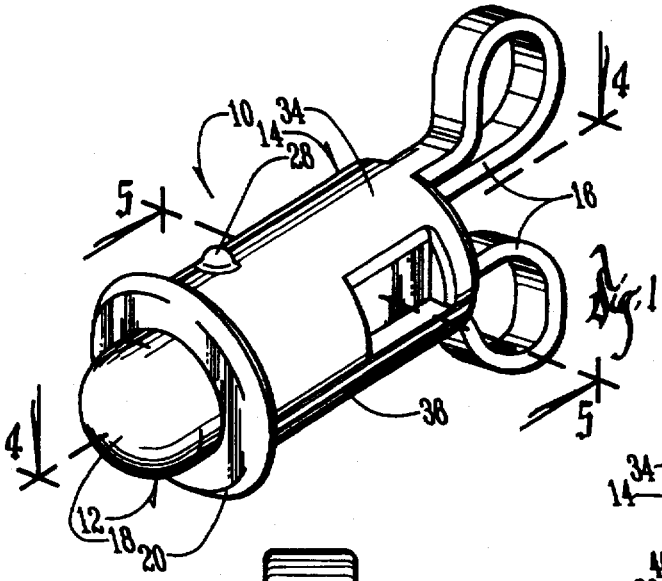
FIG. 1 is a perspective of the preferred embodiment of the detent device.
Figure 5:
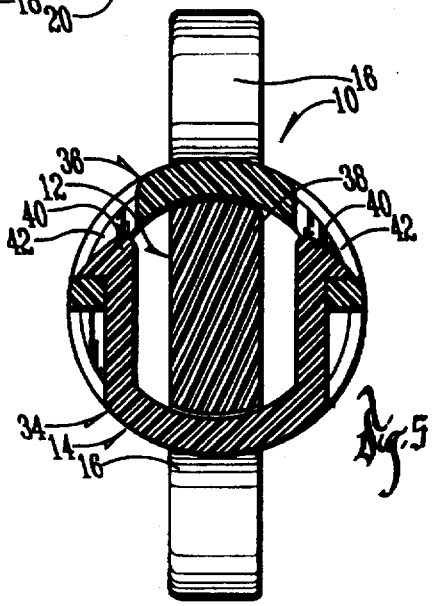
FIG. 5 is an enlarged sectional view taken along line 5—5 of FIG. 1.
Figure 4:
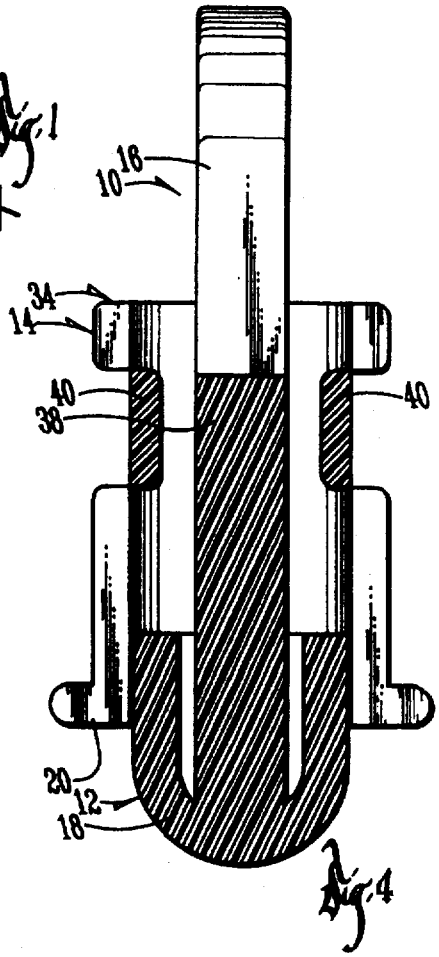
FIG. 4 is an enlarged sectional view taken along line 4—4 of FIG. 1.

FIG. 1 shows a preferred embodiment of the detent device 10. The detent device 10 has an elongated plunger 12 mounted inside a cylinder or sleeve 14. Leaf springs 16 connect the plunger 12 and the cylinder or sleeve 14. Each leaf spring 16 is doubled back on itself between the plunger 12 and the cylinder or sleeve 14. The plunger 12 is mounted within the cavity of the cylinder or sleeve 14.

The leaf springs 16 urge the plunger 12 into an extended position in which the nose 18 of the plunger 12 extends beyond the retaining flange 20 of the sleeve 14. When a force is applied to the plunger nose 18 along its longitudinal axis, the plunger nose 18 moves to a retracted position toward the cavity of the cylinder or sleeve 14.

Figure 2:
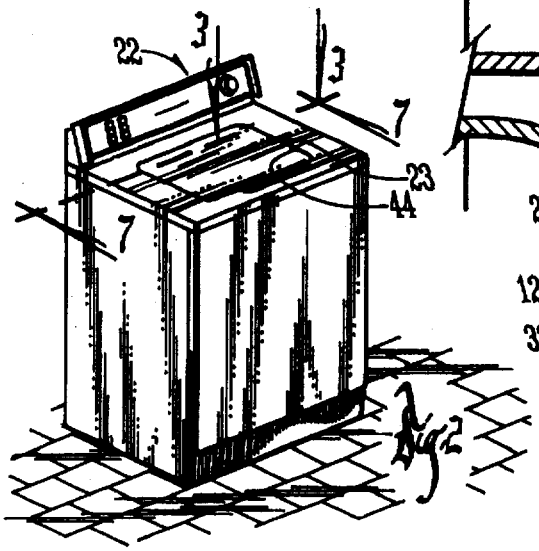
FIG. 2 is a perspective view of a fabric washing machine in which the detent device is used.
Figure 3:
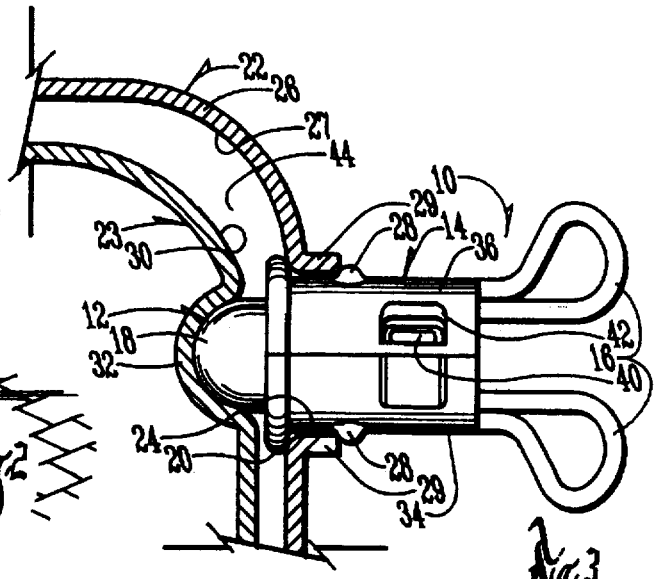
FIG. 3 is a sectional view taken generally along line 3—3 of FIG. 2 showing the detent device and the door in an assembled position.
Figure 7:
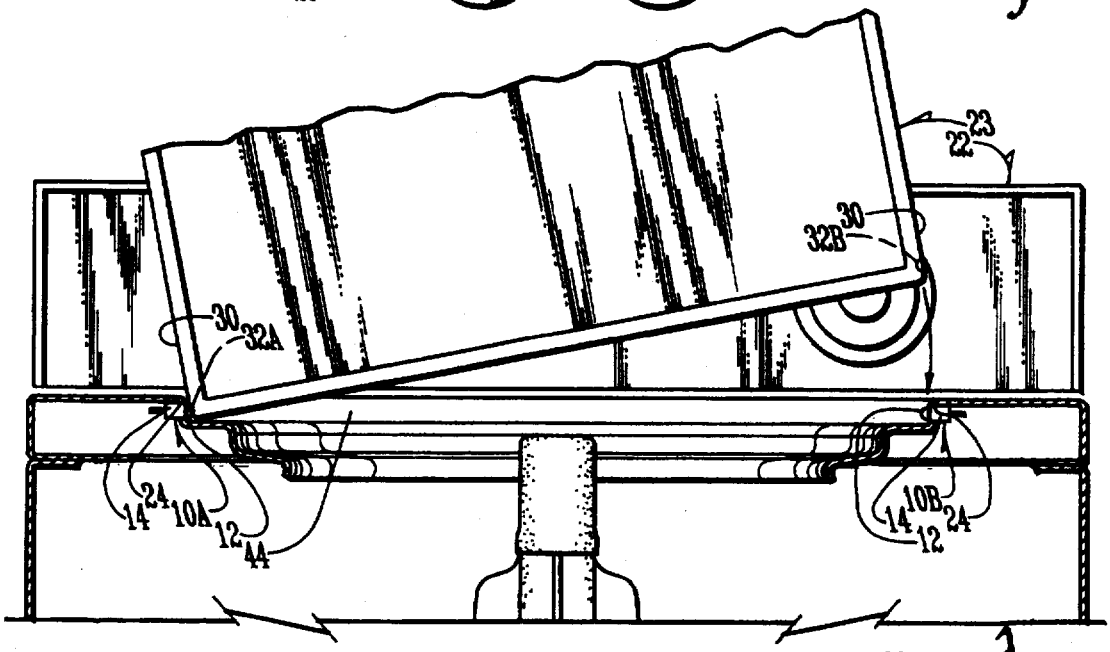
FIG. 7 is a sectional view taken generally along line 7—7 of FIG. 2, showing the insertion of the door into the door opening.

The detent device 10 can be used in a variety of applications and is particularly well-suited for hinging a door on a frame, such as a fabric washing machine 22 as shown in FIG. 2. The detent device 10 can be mounted in an extruded aperture 24 along a side margin 26 of a door opening 44 in the top of the washing machine 22 (FIGS. 3 and 7). The retaining flange 20 abuts the inner surface 27 of the side margin 26. Retaining nubs 28 are positioned along the outer surface of the sleeve 14 and secure the sleeve 14 in the aperture 24 between the aperture wall 29.

The side edge 30 of the door 23 has a detent receptacle 32. FIG. 3 shows the detent device 10 and the door 23 in an assembled position, in which the leaf springs 16 of the detent device 10 urge the plunger 12 into the detent receptacle 32 to retain the door 23 in a hinged position.

The detent device 10 can alternatively be mounted in the side edge 30 of door 23 with detent receptacle 32 provided in the side margin 26 of the frame 22.

Figure 6:
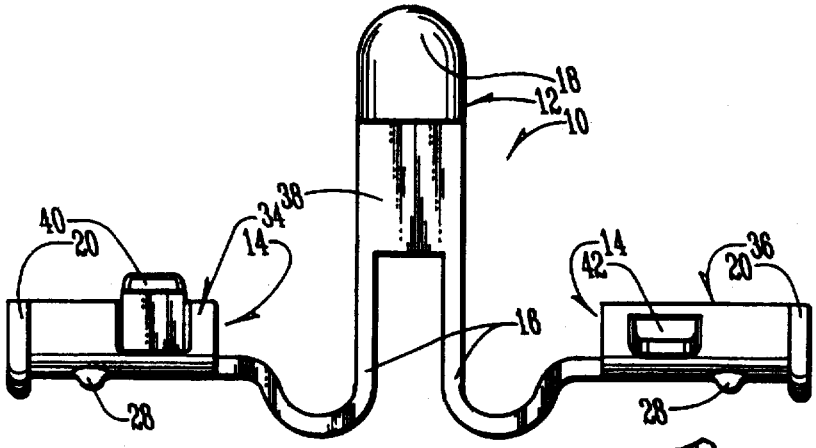
FIG. 6 is a side elevational view showing the detent device in the as formed position.

As shown in FIG. 6, it is preferred that the plunger 12, the sleeve 14, and the leaf springs 16 be integrally formed with one another. The configuration shown in FIG. 6 is made of molded plastic and is shaped substantially as shown when it is removed from the mold. Sleeve portions 34 and 36 are used to form sleeve 14. To attach portions of the sleeve 34 and 36, the sleeve portions are positioned around the plunger 12 and a latch 40 is received in a slot 42.

A supporting wall 38 connects and extends between a portion of the leaf springs 16. The supporting wall 38 provides the leaf springs 16 with the necessary tension and also supports the plunger 12 as it is urged to its extended position beyond the retaining flanges 20.

The detent device 10 can be made from a variety of different materials. It is preferred, however, that the detent device be integrally formed from molded plastic. Plastic has sufficient resiliency and tension to project the plunger 12 beyond the sleeve 14. Also, plastic is less likely to chip the paint or other coatings on the door 23 or frame 22.

Figure 8:
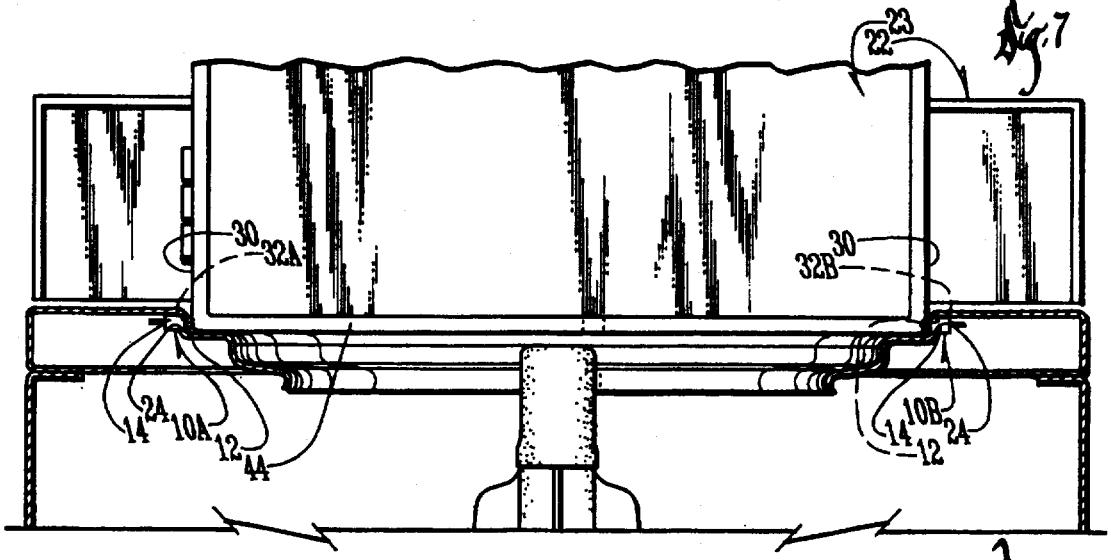
FIG. 8 is a sectional view also taken generally along line 7—7 of FIG. 3 showing the door hingeably mounted in an assembled position.

FIGS. 7 and 8 illustrate how the door 23 can easily and quickly be inserted into a door opening 44. First, the plunger nose 18 of the first detent device 10*a* is inserted into the first detent receptacle 32*a* on the door. Next, the door is moved into a hinged position where the plunger nose 18 of the second detent device 10*b* extends within the second detent receptacle 32*b*. During the insertion of the door 23, the plunger 12 of the second detent device 10*b* is forced into a retracted position and then is returned to an extended position in the second detent receptacle 32*b*. Because the plunger is allowed to pivot between a retracted and an extended position, the structure of the appliance is not damaged and the surface coatings are not scratched or marred.

Once the detent devices 10*a* and 10*b* are positioned within the detent receptacles 32*a* and 32*b*, the door can pivot between open and closed positions. Again, note that the detent devices 10*a* and 10*b* can alternatively be mounted in the door 23 and the detent receptacles 32*a* and 32*b* positioned in the frame 22 to accomplish a similar hinging mechanism.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A detent device comprising:

a sleeve having a cavity, said sleeve having at least a first opening therein providing communication into said cavity;

an elongated plunger mounted within said cavity and having a plunger nose and a longitudinal axis;

said plunger being movably attached to said sleeve and being retractable within said cavity from an extended position wherein said plunger nose protrudes outside said first opening of said sleeve to a retracted position wherein said plunger nose is moved toward said cavity;

a spring mechanism yieldably urging said plunger to said extended position.

2. In combination:

first and second members, each having a facing surface, said facing surface of said first member including a detent receptacle therein, said facing surface of said second member being in-spaced facing relation to said facing surface of said first member;

a detent device comprising a sleeve having a cavity therein, said sleeve having at least a first opening therein providing communication into said cavity;

an elongated plunger mounted within said cavity and having a plunger nose and a longitudinal axis;

said plunger being retractable within said cavity from an extended position wherein said plunger nose protrudes outside said first opening of said sleeve to a retracted position wherein said plunger nose is moved toward said cavity;

a spring mechanism integrally attached to said sleeve and said plunger and yieldably urging said plunger to said extended position;

said detent device being operatively attached to said facing surface of said second member with said plunger nose protruding within said detent receptacle of said first member;

said plunger nose being yieldably retractable out of said detent receptacle in response to a predetermined force being applied to move said first member relative to said second member in a direction transverse to said longitudinal axis of said plunger.

3. In combination:

a wall having a door opening therein, said door opening having opposite spaced apart first and second margins;

a door positioned between said first and second margins, said door having a first door edge adjacent and facing said first margin of said door opening and having a second door edge adjacent and facing said second margin of said door opening;

a first hinge between said first door edge and said first margin;

a second hinge between said second door edge and said second margin;

said first and second hinges providing hinged movement of said door about a single hinge axis;

each of said first and second hinges comprising a detent device and a detent receptacle, said detent device of said first hinge being on one of said first door edge and said first margin and said detent receptacle of said first hinge being on the other of said first door edge and said first margin;

said detent device of said second hinge being on one of said second door edge and said second margin and said receptacle of said second hinge being on the other of said second door edge and said second margin;

each of said detent devices comprising a sleeve having a cavity therein, said sleeve having at least a first opening therein providing communication into said cavity;

an elongated plunger mounted within said cavity and having a plunger nose and a longitudinal axis;

said plunger being retractable within said cavity from an extended position wherein said plunger nose protrudes outside said first opening of said sleeve to a retracted position wherein said plunger nose is moved toward said cavity;

a spring mechanism integrally attached to said sleeve and said plunger and yieldably urging said plunger to said extended position;

said plungers of said detent devices in said first and second hinges protruding within said detent receptacles of said first and second hinges respectively;

said plunger of at least one of said detent devices being yieldably retractable into said sleeve thereof in response to a force of predetermined magnitude being applied to said door in a direction parallel to said hinge axis.

4. A detent device comprising:

a sleeve having a cavity, said sleeve having at least a first opening therein providing communication into said cavity;

an elongated plunger mounted within said cavity and having a plunger nose and a longitudinal axis;

said plunger being retractable within said cavity from an extended position wherein said plunger nose protrudes outside said first opening of said sleeve to a retracted position wherein said plunger nose is moved toward said cavity;

a spring mechanism integrally attached to said sleeve and said plunger and yieldably urging said plunger to said extended position;

said sleeve, said plunger and said spring mechanism being integrally formed with one another.

5. A detent device according to claim 4 wherein said sleeve, said plunger, and said spring mechanism are formed from molded plastic.

6. A detent device according to claim 1 wherein said sleeve comprises two or more segments which are secured to one another along a longitudinal seam to form said sleeve.

7. A detent device according to claim 1 wherein said sleeve comprises two segments which are semi-cylindrical in shape and secured together along a longitudinal seam parallel to said longitudinal axis of said plunger.

8. A detent device according to claim 7 wherein one of said segments has a latch tab protruding therefrom and another of said segments has a slot therein for lockingly receiving said tab when said tab is extended across said longitudinal seam so as to secure said segments together to form said sleeve.

9. A detent device comprising:

a sleeve having a cavity, said sleeve having at least a first opening therein providing communication into said cavity;

an elongated plunger mounted within said cavity and having a plunger nose and a longitudinal axis;

said plunger being retractable within said cavity from an extended position wherein said plunger nose protrudes outside said first opening of said sleeve to a retracted position wherein said plunger nose is moved toward said cavity;

a spring mechanism connected to said sleeve and said plunger and yieldably urging said plunger to said extended position, said spring mechanism comprising at least one elongated leg having a first end connected to said plunger and a second end connected to said sleeve, said leg being doubled back on itself between said first and second ends.

* * * * *